United States Patent [19]

Fuzek

[11] 4,098,946

[45] Jul. 4, 1978

[54] POLYESTER FILAMENT CONTAINING ORGANOPHILIC KAOLIN

[75] Inventor: John Frank Fuzek, Kingsport, Tenn.

[73] Assignee: Eastman Kodak Company, Rochester, N.Y.

[21] Appl. No.: 802,088

[22] Filed: May 31, 1977

[51] Int. Cl.[2] ..... B32B 27/02; B32B 27/20; D02G 3/02

[52] U.S. Cl. ..... 428/357; 428/372; 428/397

[58] Field of Search ..... 428/372, 397, 357

[56] References Cited

U.S. PATENT DOCUMENTS

| | | | |
|---|---|---|---|
| 2,901,466 | 8/1959 | Kibler et al. | 260/47 C |
| 3,260,715 | 7/1966 | Saunders | 8/19 |
| 3,660,134 | 5/1972 | Morris et al. | 106/288 B |
| 3,697,474 | 10/1972 | Morris et al. | 260/40 R |
| 3,705,225 | 12/1972 | Taylor | 264/103 |
| 3,804,937 | 4/1974 | Morris et al. | 264/211 |

*Primary Examiner*—J. C. Cannon

*Attorney, Agent, or Firm*—William P. Heath, Jr.; Daniel B. Reece, III

[57] ABSTRACT

Silk-like fibers comprising poly(1,4-cyclohexylenedimethylene terephthalate) and modified poly(1,4-cyclohexylenedimethylene terephthalate), the fibers having a non-round cross section, having a denier per filament of about 1.5 and containing 1–5% organophilic kaolin, the kaolin having a particle size of 90% less than 1 micron.

7 Claims, No Drawings

POLYESTER FILAMENT CONTAINING ORGANOPHILIC KAOLIN

This invention relates to polyester fiber having silk-like aesthetics. More particularly the invention relates to particular polyester fibers having silk-like aesthetics.

Historically, silk has been one of the most wanted fibers due to its aesthetics and crisp hand. Silk is obtained by stripping the fiber from the cocoons of the larvae of the Bombyx Mori. The processing and availability of the silk fiber results in the price of fabrics made of silk to be very high as compared to fabrics made of synthetic fibers.

With the advent of man-made fibers, there has been a continuing effort to simulate silk. When rayon was first produced commercially, it was sold as artificial silk. In producing these man-made fibers, the ability to design properties to suit different end uses has become available. Many attempts have been partially successful in approaching the properties of silk, but prior to the present invention, no one has succeeded in matching the warm deep luster, the liveliness and the attractive luxurious hand of natural silk.

In U.S. Pat. No. 3,705,225 a fiber reported to have silk-like appearance is disclosed. Here the inventor adds a surface modifying agent to polyester yarn prepared by melt spinning through non-round spinneret orifices, the modifying agent being present to produce a rough-surfaced yarn. The polyester preferred is poly(ethylene terephthalate) and the preferred surfae roughening agent is kaolinite. Other agents include calcium terephthalate, potassium acetate, potassium terephthalate and potassium 3,5-di(carbomethoxy)benzenesulfonate.

The present invention is directed to luxury type polyester filament and yarns having silk-like aesthetics. I have found that the lustrous nature of silk can be essentially duplicated by the incorporation in the fiber of about 1 to 5% of an organophilic kaolin (such as Kaolin OX-1 ®) having a particle size of about 90% $< 1\mu$ with a diameter to thickness ratio of about 6/1. Kaolin clays are hydrophilic materials by nature and are readily wet by water, but not by organic materials such as polyester. The organophilic kaolin useful in this invention is disclosed in U.S. Pat. Nos. 3,171,718, 3,697,474, 3,660,134 and 3,804,937.

The luxurious hand or handle of silk fabrics can be obtained by the use of differentially shrinking filaments. Theretofore it has been thought that in order to obtain differential shrinkage in the silk-like yarn that the filaments must be produced by a process in which two processing lines are used and the filaments combined prior to use as disclosed in U.S. Pat. No. 3,705,225. In my invention I have unexpectedly obtained differentially shrinking filaments from a single processing line in the novel combinations of poly (1,4-cyclohexylenedimethylene terephthalate) polymers disclosed earlier and the organophilic kaolin described in this application.

The fibers of this invention are formed with non-round cross-sections such as trilobal, trilaterial, delta or other variants of generally triangular cross-sections. Also, I prefer to use about 200 ppm of an optical brightener in the polymer. For example, that disclosed in U.S. Pat. No. 3,260,715 may be used.

This invention will be further illustrated by the following examples although it will be understood that these examples are included merely for purposes of illustration and are not intended to limit the scope of the invention.

EXAMPLE 1

A 65/43 trilateral cross-section filament yarn is spun from poly(1,4-cyclohexylenedimethylene terephthalate) polymer containing 2% of organophilic kaolin (Kaolin OX-1) and 200 ppm of an optical brightener. Spinning is carried out in the usual manner except that a heated hood is used below the spinneret to maintain the fiber at a higher temperature, ~240° C for 12 inches below the face of the spinneret. Yarn is taken up at ~1000 m./min. Drafting is carried out in the usual manner using a draft ratio of ~3:1. An antistatic lubricant is applied to the fiber during spinning. Fiber so produced had the following typical properties:

Tenacity: 3.0 g./den.
Elongation: 23%
Modulus: 40 g./den.
Boiling water shrinkage: 4.0%
Air shrinkage at 175° C.: 7.8%
Liveliness index: 0.23[1]
Work recovery at 5%: 56%
Inherent Viscosity: 0.63[2]

Goniophotometric curves of luster were very similar to those of degummed and bleached silk fibers. Differential shrinkage of filaments at 175° C. is from 4.5% to 9% with two populations, one peaking at 6%, the other at 8%.

[1]Liveliness index is a measure of the liveliness of the fiber—the more lively the fiber the higher the index. Liveliness index is determined by stretching the fiber 5 percent at a rate of 10 percent of the initial fiber length per minute and then allowing the fiber to return at the same rate while the stress strain curve is plotted on an automatic recorder. The liveliness index is the ratio of the square root of the elastic modulus ($E_i$) to secant recovery modulus ($E_r$): Liveliness index = $\sqrt{E_i/E_r}$

[2]Inherent viscosity is determined at 25° C. in 60/40 phenol/tetrachloroethane at a concentration of 0.5 g./100 ml.

EXAMPLE 2

A 65/43 trilateral cross-section filament yarn is spun from poly(1,4-cyclohexylenedimethylene terephthalate) polymer containing 2% organophilic kaolin (Kaolin OX-1) and 200 ppm of an optical brightener. Spinning and drafting are carried out by a one-step operation in which the take-up speed is ~3000 m./min., a jet shield is used and counter-current quench air of 180° C. with an air flow rate of 100 ft./min. is used. An antistatic fiber lubricant is applied during spinning. Typical fiber properties obtained were:

Tenacity: 3.4 g./den.
Elongation: 24%
Modulus: 43
Boiling water shrinkage: 4.5%
Air shrinkage at 175° C.: 9.7%
Liveliness index: 0.23
Work recovery at 5%:58%
Inherent Viscosity:0.64

Goniophotometric curves of luster were very similar to those of degummed and bleached silk fibers. Differential shrinkage of filaments at 175° C. is from 5% to 11.5% with two populations, one peaking at 8%, the other at 10.5%.

EXAMPLE 3 — (COMPARATIVE)

A 65/43 trilateral cross-section filament yarn is spun from poly(ethylene terephthalate) polymer containing 2% organophilic kaolin (Kaolin OX-1) and 200 ppm of an optical brightener. Spinning is carried out in the usual manner using a draft ratio of ~4:1. An antistatic lubricant is applied to the fiber during spinning. Fiber so produced had the following typical properties:

Tenacity:3.8 g./den.
Elongation:31%
Modulus:47 g./den.
Boiling water shrinkage:4.0%
Air shrinkage at 150° C.:6.0%
Liveliness index:0.185
Work recovery at 5%:41%
Inherent Viscosity:0.55

Goniophotometric curves of luster indicated a much greater degree of specular reflection than was present for silk or for fibers of poly(1,4-cyclohexylenedimethylene terephthalate) + 2% organophilic kaolin (Kaolin OX-1). This specular reflectance is observed as a glossy appearance of fabrics made from the fiber. The desirable subdued luster of silk was not attained in this fiber. There was no differential shrinkage of the filaments present in this yarn.

EXAMPLE 4 — (COMPARATIVE)

A 65/35 trilateral cross-section filament yarn is spun from poly(1,4-cyclohexylenedimethylene terephthalate) polymer containing 2% kaolin clay having an average particle size of ~1μ. Spinning is carried out in the usual manner except that a heated hood is used below the spinneret to maintain the fiber at a higher temperature. ~240° C. for 12 in. below the face of the spinneret. Spinning this fiber is accomplished with great difficulty, since there is a tendency for the fiber to break during spinning. Yarn is taken up at speeds between ~500 m/min. and 1000 m/min. Drafting is carried out in the usual manner using a draft ratio of ~3:1, as antistatic lubricant is applied to the fiber during spinning. Fiber so produced had the following typical properties:

Tenacity:2.7 g./den.
Elongation:9%
Modulus:48 g./den.
Boiling water shrinkage:0.7%
Air shrinkage at 175° C.:5.7%
Liveliness index:0.15
Work recovery at 5%:69%
Inherent Viscosity:0.62

Goniophotometric curves of luster were similar to those of fiber produced under Example 1 except that the fiber has a lower level of reflectance, i.e., is duller, but has a greater amount of specular reflectance giving rise to a shine at mirror reflection angles. The fiber was not silk-like in appearance.

EXAMPLE 5 — (COMPARATIVE)

A 75/50 trilateral cross-section filament yarn is spun from poly(1,4-tetramethylene terephthalate) polymer containing 2% organophilic kaolin (Kaolin OX-1) and 200 ppm of an optical brightener. Spinning is carried out in the usual manner for poly(1,4-tetramethylene terephthalate) fibers. Yarn is taken up at ~1000 m/min. Drafting is carried out in the usual manner using a draft ratio of ~2.7:1. An antistatic lubricant is applied to the fiber during spinning. Fiber so produced had the following typical properties:

Tenacity:2.7 g./den.
Elongation:20%
Modulus:18 g./den.
Boiling water shrinkage:10%
Air shrinkage at 150° C.:15%
Liveliness index:0.232
Work recovery at 5%:55%
Inherent Viscosity:0.75

Goniophotometric curves of luster were very similar to those of degummed and bleached silk fibers. Differential shrinkage of the filaments was not observed for this yarn.

EXAMPLE 6

A 65/43 trilateral filament yarn is spun from a copolyester of terephthalic acid (90%) and isophthalic acid (10%) and polycyclohexanedimethanol containing 2% organophilic kaolin (Kaolin OX-1) and 200 ppm of an optical brightener under conditions described in Example 1. Similar results were obtained to those of the fibers spun under Example 1.

EXAMPLE 7

A 65/43 trilateral filament yarn is spun from the copolyester of Example 5 under conditions described in Example 2. Similar results were obtained to those of fibers spun under Example 2.

EXAMPLE 8

A 65/43 trilateral filament yarn is spun from a copolyester of poly(1,4-cyclohexylenedimethylene terephthalate) with (copolyester of 10% isophalic acid and 2%, 3,3'[(sodioimino)disulfonyl] dibenzoic acid) containing 2% organophilic kaolin (Kaolin OX-1) and 200 ppm of an optical brightener under conditions described in Example 1. Similar results were obtained to those of fibers spun under Example 1.

EXAMPLE 9

A 65/43 trilateral cross-section filament yarn is spun from the copolyester of Example 8 under conditions described in Example 2. Similar results were obtained to those of fibers spun under Example 2.

The invention has been described in detail with particular reference to preferred embodiments thereof, but it will be understood that variations and modifications can be effected within the spirit and scope of the invention.

I claim:

1. Textile yarn comprising poly(1,4-cyclohexylenedimethylene terephthalate) fiber containing about 1 to 5% by weight of organophilic kaolin, said kaolin having a particle size of 90% less than one micron with a diameter to thickness ratio of about 6/1.

2. Textile yarn of claim 1 wherein individual fibers thereof exhibit differential shrinkage.

3. Textile yarn of claim 1 wherein said individual filaments have a non-round cross section.

4. Textile fiber comprising poly(1,4-cyclohexylenedimethylene terephthalate) containing about 1 to 5 percent by weight of organophilic kaolin.

5. Textile fiber of claim 4, wherein said organophilic kaolin has a particle size 90% less than one micron with a diameter to thickness ratio of about 6/1.

6. Textile fiber of claim 4 wherein said fiber has a non-round cross section.

7. Textile fiber of claim 6 wherein said cross section is generally triangular.

* * * * *